United States Patent [19]

Lüder

[11] 4,096,703

[45] Jun. 27, 1978

[54] CONCRETE CONSTRUCTIONAL MEMBERS

[76] Inventor: Friedrich Karl Lüder, P.O. Box 2256, D-2400 Lübeck, Germany

[21] Appl. No.: 783,744

[22] Filed: Apr. 1, 1977

[30] Foreign Application Priority Data

Apr. 3, 1976 Germany ..... 2614438

[51] Int. Cl.[2] ..... E02D 5/12; E02D 5/32

[52] U.S. Cl. ..... 61/59; 61/53.74

[58] Field of Search ..... 61/59, 56, 35, 50, 49, 61/53.74

[56] References Cited

U.S. PATENT DOCUMENTS

| | | | |
|---|---|---|---|
| 910,421 | 1/1909 | Schlueter | 61/59 |
| 1,001,963 | 8/1911 | Latham | 61/59 |
| 1,373,545 | 10/1921 | Knuth | 61/59 |
| 2,941,371 | 6/1960 | Benedict | 61/49 |

FOREIGN PATENT DOCUMENTS

| | | | |
|---|---|---|---|
| 734,140 | 7/1932 | France | 61/59 |

*Primary Examiner*—Jacob Shapiro

[57] ABSTRACT

This invention relates to concrete constructional members for building walls and bulkheads and particularly moles, quay bulkheads, groins or like edifices. Such members hitherto comprised a concrete body having a vertically continuous opening in the central area and having pairs of divergent arms of different length on two opposing sides, the end faces of the shorter pair of arms being capable of being brought into contact with the inner faces of the longer pair of arms on an adjoining constructional member. According to the invention, the constructional member is formed as a concrete part having a height such that it can extend in one piece from the foot of the edifice which is to be built, to at least the vicinity of the surface of the water. Preferably, at its lower end and on the side facing in the direction of construction the member has an extension in the form of an apron which projects beyond the lower end of the member, and which masks the space between said longer arms of the cross-section except for the contact areas for said shorter arms of a succeeding concrete member. Moles, walls, quay bulkheads and like edifices can be made from concrete members as referred to by sinking a plurality of these members vertically to an underlying supporting stratum one after another and against one another with their arms engaging, with said aprons at their bottoms lying in the direction in which the edifice is being constructed whereafter the yielding ground is jetted away from under the concrete member until a firm stratum is reached, by means of a jetting pipe which is passed downwards through the continuous central opening, after which the space formed by the washing out operation is filled with gravel, rubble or the like through said vertical central opening to bed said member in position.

8 Claims, 5 Drawing Figures

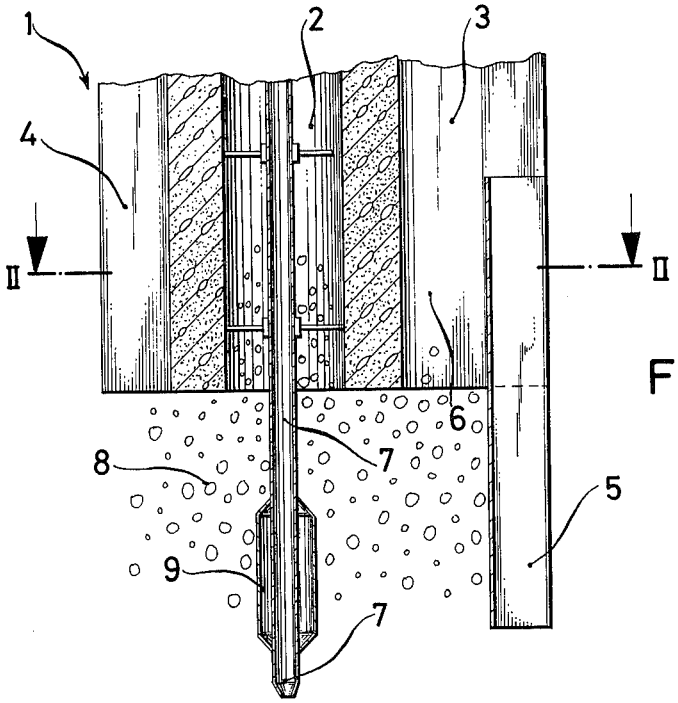
FIG.1
FIG.2
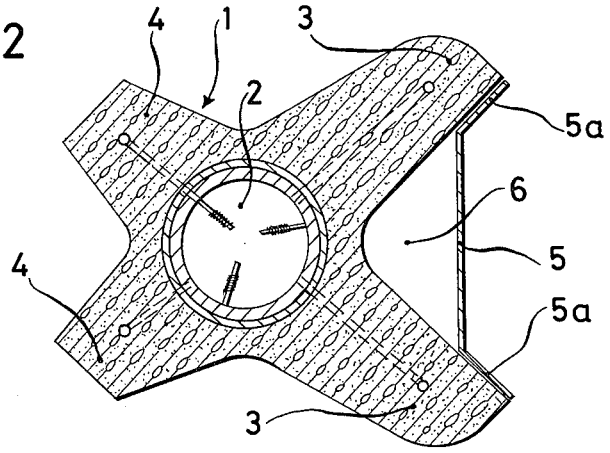
FIG.4
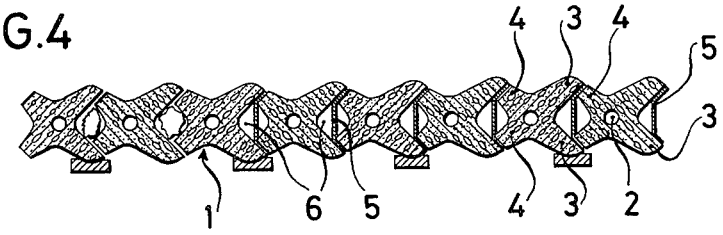

CONCRETE CONSTRUCTIONAL MEMBERS

BACKGROUND OF THE INVENTION

The present invention relates to concrete constructional members particularly for building moles, quay bulkheads, groins or like edifice, consisting of a concrete body having a vertically continuous opening in the central area and having pairs of divergent arms of different length on two opposing sides, the end faces of the shorter arms being capable of being brought into contact with the inside faces of the longer pair of arms on an adjoining constructional member. The invention also relates to a method of producing moles, quay bulkheads or like edifices from concrete constructional members.

It is known from German patent specification No. 1 958 814 to produce moles, quay bulkheads, groins or like edifice from constructional members of the kind described above by lining the members up next one another in engagement and stacking them on top of one another and after the edifice has been erected, by filling the continuous central openings in the members and/or the cavities formed between the pairs of arms with gravel, rubble or concrete or passing reinforcing piles through them which are driven into the underlying strata.

Although known constructional members having the cross-sectional shape in question give satisfactory results in the construction of moles, quay bulkheads or like edifices, it has frequently been found in practice to be very difficult to stack the individual constructional members and to level them up along the edifices, particularly when the latter has to be constructed under water.

While using the outline shape of known constructional members, the object of the invention is considerably to simplify and facilitate the construction of edifices of the kind referred to earlier.

SUMMARY OF THE INVENTION

To achieve this and other objects, the invention consists in the fact that the constructional member as referred to above is formed as a concrete part of a height to extend in one piece from the foot of edifice which is to be built, to at least the vicinity of the surface of the water. Advantageously, at its lower end and on the side facing in the direction in which construction progresses, the concrete part has an extension in the form of an apron which projects beyond its lower end and which masks the space between the longer arms of the cross-section except for the contact areas for the shorter arms of the succeeding concrete part.

By these provisions, the invention makes it easier for the concrete parts to be sunk vertically to the underlying strata next to one another and in engagement with one another from the land or from a boat, using a suitably heavy-duty crane, and if necessary for them to be jetted in until a firm substratum is reached and for them to be anchored at their upper ends by bracing. By this means the construction of quay bulkheads, moles or like edifices is considerably simplified and can progress continuously under supervision from above the surface of the water. In comparison with known constructional members of lesser height which are placed in position next to and on top of one another individually, bulkheads, walls or like edifices make of such concrete parts demonstrate an at least equal interlocking effect, that is to say the effect whereby, when the individual concrete parts have been placed in position, they remain held together in the edifice without requiring any additional anchorage by driven-in piles. The anchorage may now be provided at the surface of the water by bracing or the like. Since the underlying strata are uneven in certain cases the concrete parts may project to different heights above the level of the water, and in this case constructional members of lesser height as disclosed in German Pat. No. 1 958 814 are placed on top of them until the upper edge of the bulkhead is of uniform height.

To construct quay bulkheads, moles or the like from the concrete parts according to the invention, the procedure adopted is to sink the concrete parts vertically to a supporting stratum one after another and against one another with their arms engaging, with the lower aprons hereinabove referred to lying in the direction in which the edifice is being constructed, the ground in the vicinity of their foot ends being jetted away by means of a jet pipe introduced through the continuous central opening until a firm stratum is reached, and the space which has been washed out then being filled with gravel, rubble or concrete or the like through the central opening in order to bed in the concrete part, and the filling being compacted by means of a vibrator probe.

While these successive operations of sinking, jetting and filling the space which has been washed out are going on, the apron on the concrete part which has already been bedded in prevents its bedding from being washed away while the next part is being set up and jetted into place. The apron thus forms a shield against the water used for jetting and also a deflecting surface by which the water used for jetting and the earth which is washed out are deflected sideways off the apron of the part which has already been bedded in and to some extent, off the apron of the neighbouring part which is being installed, thus resulting in a broad, firm bed for the concrete parts forming the edifice which are being sunk into place. At the same time it is advantageous to compact the rubble filling by means of a vibrator.

BRIEF DESCRIPTION OF THE DRAWINGS

In order that the invention may be more clearly understood, reference will now be made to the accompanying drawings which show certain embodiments thereof by way of example and in which:

FIG. 1 is a vertical section through the bottom part of a constructional member in the form of a concrete part, taken in the plane in which the construction of a bulkhead, mole or like edifice progresses, FIG. 2 is a horizontal section on line II—II of FIG. 1, FIG. 4 is a horizontal section on line IV—IV of FIG. 3.

DETAILED DESCRIPTION OF PREFERRED EMBODIMENTS

Figure 3:
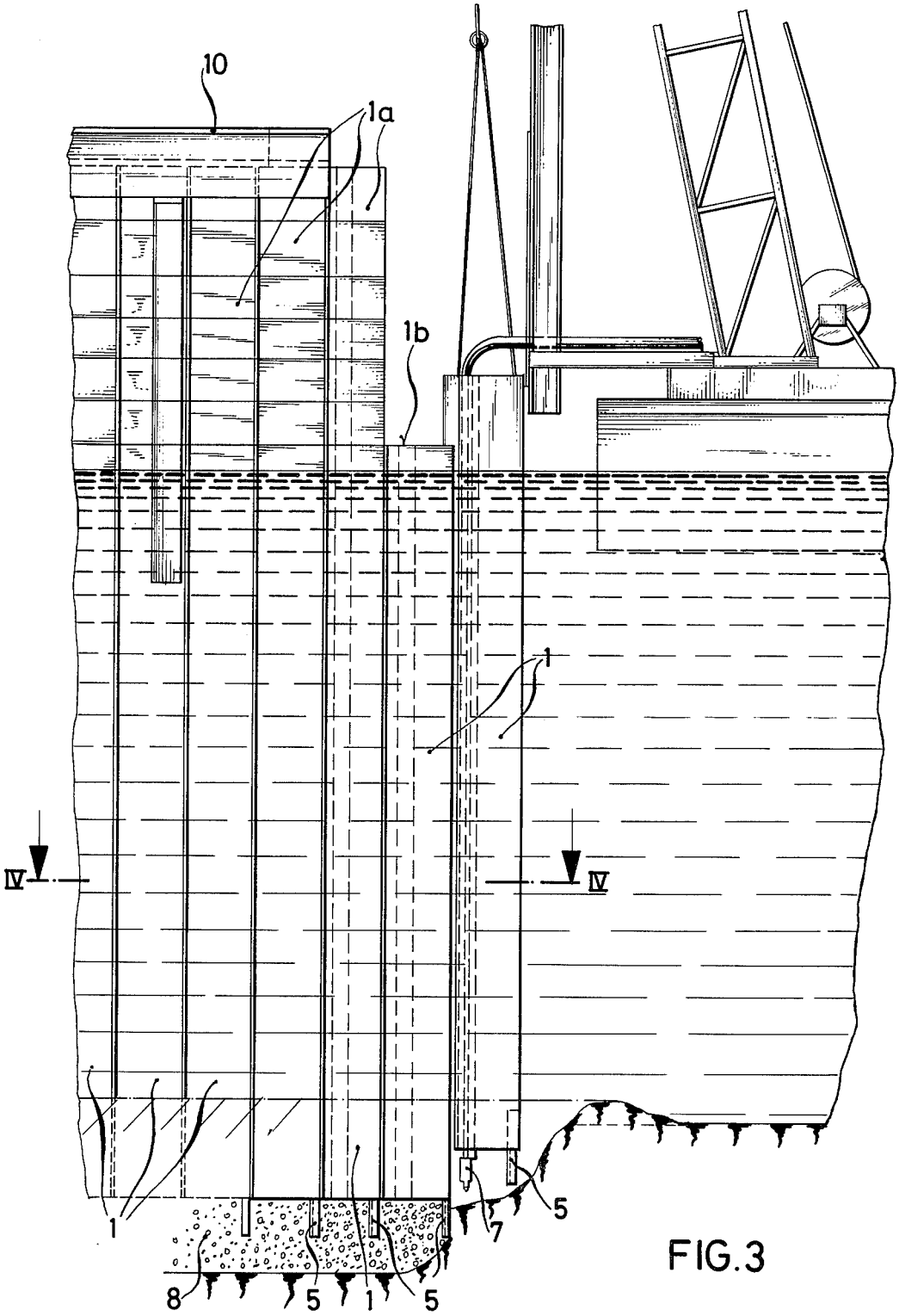
FIG. 3 is a reduced-scale elevation view of a mole, quay bulkhead or like edifice under construction.
Figure 5:
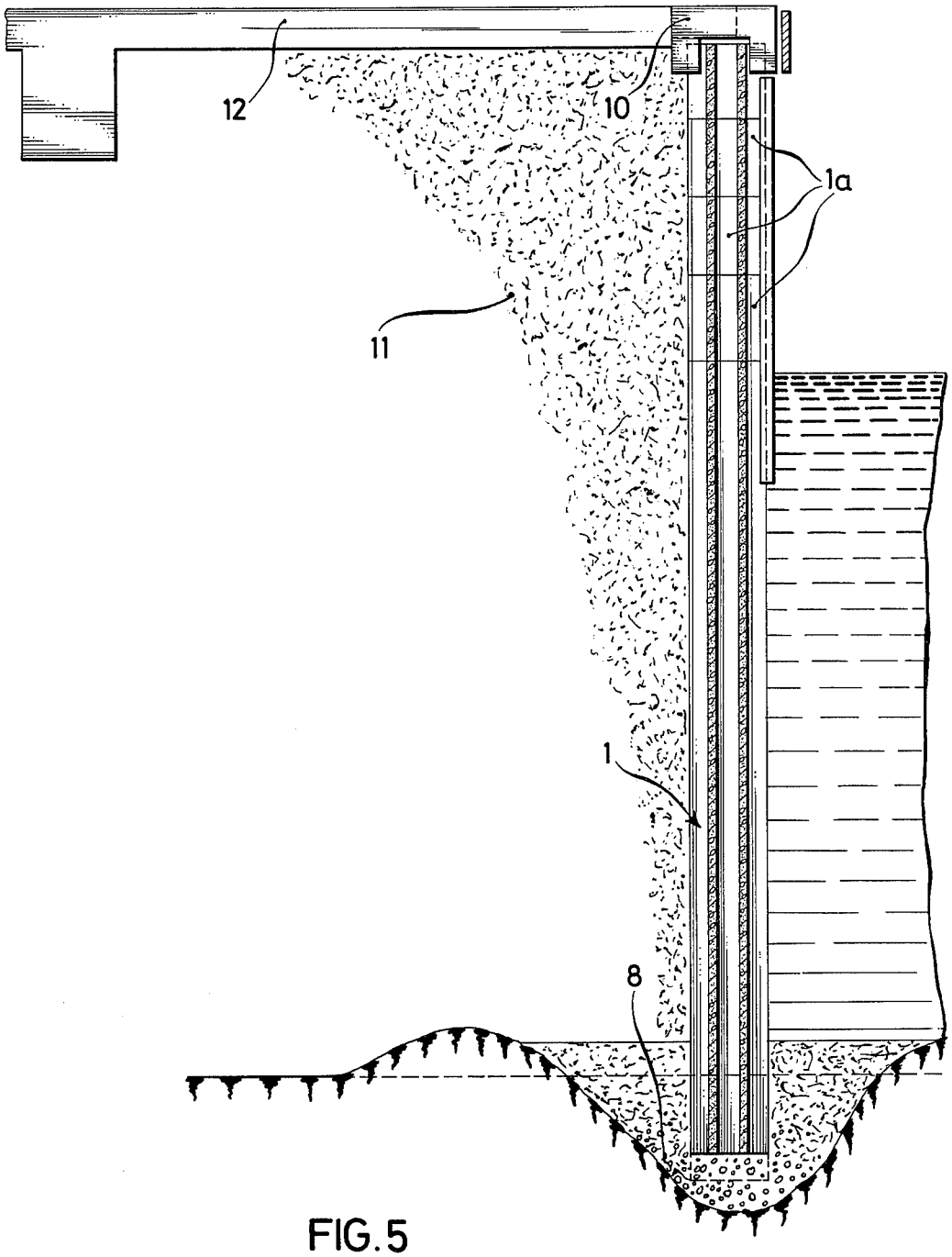
FIG. 5 is a vertical section through a finished quay bulkhead constructed from concrete parts according to the invention.

In accordance with the invention, the constructional member for building moles, quay bulkheads, walls, groins or like edifices consists of a one-piece concrete part 1 whose concrete body is provided with a central opening 2, i.e. a continuous bore or hole, for its entire height. In height, the concrete part 1 reaches from the foot of the bulkhead or like edifice to be built to at least the area where the surface of the water is situated. On respective ones of two opposing sides the concrete part is provided with pairs of divergent arms 3 and 4 of different length which are matched to one another in such a way that when the parts are lined up against one another the flat ends of the pairs of short arms 4 on one part come into contact with the ends of the inner faces of the longer arms 3 on an adjoining part, as can be seen in FIG. 4.

Usually, when erecting a mole quay or the like, the concrete parts are lined up against each other in such manner that allows for a short distance or displacement between them. As seen from the left side of FIG. 4, there is a short distance or gap between the end faces of the short arms 4 and the ends of the inner faces of the longer arms 3 on an adjoining part. The effect of this feature of the invention is to allow each concrete part to lower itself or otherwise vertically adjust its position when the ground is yielding, without affecting the adjoining concrete parts. Otherwise, the concrete parts are in contact with each other only over gravel, rubble, and the like, and naturally somewhat over the apron 5 at the foot thereof. This feature provides the mole or other edifice with greater flexibility and effectiveness against any changes and shifts in ground level.

At the bottom end, each concrete part 1 has an extension in the form of an apron 5, made of sheet steel for example, which masks the inner portion 6 of the space between the lower ends of the arms 3 and of which the angled sides 5*a* rest against the ends of the inner faces of the arms 3 and are connected at these points to the arms 3. The concrete body of the part 1 and the arms 3, 4 may be reinforced with inserted rods. The apron 5 projects beyond the lower end of member 1 by an amount equal to about half the cross-section of the member.

To construct moles, quay bulkheads, walls or like edifices using the concrete parts 1 described above, the following procedure is adopted:

A concrete part 1 is taken up by a crane and is lowered in a vertical position in such a way that the arms 3 and the sheet-steel apron 5 lie in the direction in which the mole or like edifice is being constructed. When this is done, a jetting pipe 7 is passed through the central longitudinal opening 2 in the part, where it is centred, e.g. hydraulically, by supports. The jetting water from the pipe 7 washes away weak ground until a firm substratum is reached. The space which has been scoured out is filled from above, through the central opening 2, with gravel 8, rubble or concrete, to act as a bedding for the lower end of the part, in which case it is advantageous to compact the bedding 8 by means of a vibrator 9 which may for example be connected to the pipe 7. The next concrete part 1 is then lowered with its arms 4 engaging in the arms 3 of the part already sunk, and the loose, yielding ground is once again washed away by means of the pipe 7, which is lowered through its opening 2, without affecting the bedding of the part sunk previously. This is achieved by means of the apron 5 on the previous part and also, to some extent, by means of the apron 5 on the adjacent part which is being lowered, given that the first apron shields the bedding from being washed away and, as a result of its configuration the jetting water and deflects the loose ground under the part being sunk to both sides of the edifice between itself and the apron of the part being sunk. This opens out a broad, free bedding space for the part being sunk until a firm substratum is reached, whereupon the part is bedded in the space which has been scoured out by filling the space with gravel or the like.

The height of the concrete parts 1 is made such that as far as possible they reach the surface of the water after being sunk and bedded in. They are then anchored at right angles to the edifice at the upper end, with the anchorages engaging in recesses at the upper ends of the concrete parts 1 and in the case of quay bulkheads for example being anchored in the ground perpendicularly to the bulkhead. The anchoring shackle is marked 1*b* (FIG. 3).

As soon as the concrete parts have been sunk and bedded in over the appropriate length for the edifice, the construction can be increased in height as desired above the surface of the water by placing constructional members 1*a* of smaller height, as disclosed in German Pat. No. 1 958 814, on the top of the concrete parts, these members being of the same cross-sectional shape as the concrete parts 1. When the substratum is uneven, the members of lesser height compensate for differences in height between the concrete parts which have been sunk and after they have been placed in position the central openings 2 and the spaces between the arms 3, 4, are filled with gravel, rubble, concrete or the like. After the edifice has been erected, its upper end is capped with ready made U-shaped components 10 and a filling 11 is applied at the side which is topped off with concrete 12 laid on site.

I claim:

1. In a concrete constructional member for building walls and bulkheads and particularly moles, quay bulkheads, groins or the like edifices, consisting of a concrete body having a vertically continuous opening in the central area and having pairs of divergent arms of different length on two opposing sides, the end faces of the shorter pair of arms being capable of being brought into contact with the inner faces of the longer pair of arms on an adjoining constructional member, the improvement which consists in that the constructional member is formed as an integral part of concrete extending in height from the foot of an edifice which is to be built, to at least the vicinity of the surface of the water, and the lower end of the constructional member, on the side facing in the direction of construction, having an extension in the form of an apron which projects beyond the lower end of the constructional member and which masks the space between said longer arms of the cross-section, except for the contact areas for said shorter arms of a succeeding concrete member.

2. A concrete member according to claim 1, wherein said apron is made from sheet steel, and projects beyond the lower end of said concrete member by an amount equal to approximately half the cross-section of said member.

3. A concrete member according to claim 2, wherein said sheet-steel apron is of U-shaped and its divergent sides rest against the outer portions of the inner faces of said longer arms and form the contact areas for the end-faces of said shorter arms of its associated member.

4. A concrete member according to claim 1, wherein the end faces of the shorter pair of arms are displaced a relatively short distance from the inner faces of the longer pair of arms and define a gap therebetween so that each concrete member can vertically adjust its position when the ground is yielding.

5. A concrete member according to claim 1, wherein the end faces of the shorter pair of arms are in contact with the inner faces of the longer pair of arms, only when adjoining concrete members are over gravel, rubble, and the like.

6. A method of producing moles, walls, quay bulkheads and, like edifices from concrete members of the kind set forth in claim 2, which method consists in sinking said concrete members vertically to an underlying supporting stratum one after another and against one another with their arms engaging, with said aprons at their bottoms lying in the direction in which the edifice is being constructed, jetting away the yielding ground from under said concrete members, until a firm substratum is reached, by means of a jetting pipe which is passed downwards through said continuous central opening, after which the space formed by the washing out operation is filled with gravel, rubble or the like through said vertical central opening to bed said member in position.

7. A member according to claim 6, wherein the bedding for the lower end of said member is compacted by a vibrator connected to said jetting pipe.

8. A method according to claim 7, wherein the upper face of the mole edifice when constructed from said concrete members is levelled to a uniform height by means of constructional bodies placed on top of said members, which bodies are of the same cross-sectional shape as said members but of lesser height.

* * * * *